US012478192B2

(12) United States Patent
Liu et al.

(10) Patent No.: US 12,478,192 B2
(45) Date of Patent: Nov. 25, 2025

(54) RECLINER CHAIR, LOVE SEAT, OR SOFA WITH PROTECTIVE COVER

(71) Applicants: Chih Hsiung Liu, Benoni (ZA); Mei Jun Xu, Jiujiang (CN); Kui Zhao, Changzhou (CN)

(72) Inventors: Chih Hsiung Liu, Benoni (ZA); Mei Jun Xu, Jiujiang (CN); Kui Zhao, Changzhou (CN)

(73) Assignee: MOTOMOTION CHINA CORPORATION, Changzhou (CN)

( * ) Notice: Subject to any disclaimer, the term of this patent is extended or adjusted under 35 U.S.C. 154(b) by 160 days.

(21) Appl. No.: 18/207,961

(22) Filed: Jun. 9, 2023

(65) Prior Publication Data

US 2024/0407566 A1 Dec. 12, 2024

(51) Int. Cl.
*A47C 1/032* (2006.01)
*A47C 1/034* (2006.01)
*A47C 31/00* (2006.01)

(52) U.S. Cl.
CPC ..... *A47C 31/00* (2013.01); *A47C 1/0342* (2013.01)

(58) Field of Classification Search
CPC ..... A47C 1/0355; A47C 17/04
USPC ..... 297/85, 90, 84
See application file for complete search history.

(56) References Cited

U.S. PATENT DOCUMENTS 3,492,045 A * 1/1970 Schefthaler ..... A47C 1/0355 297/75
5,156,441 A * 10/1992 Byersmith ..... A47C 13/005 297/75
5,419,611 A * 5/1995 Cook ..... A47C 1/0355 297/75
5,478,133 A * 12/1995 Tidwell, Jr. ..... A47C 7/42 297/440.1
2011/0175426 A1* 7/2011 Lawson ..... A47C 1/0355 297/85 M
2012/0049606 A1* 3/2012 Lawson ..... A47C 1/0355 74/521
2012/0299363 A1* 11/2012 Crum ..... A47C 1/0352 297/85 M
2014/0049084 A1* 2/2014 Lawson ..... A47C 1/032 297/340
2019/0116978 A1* 4/2019 Jorbel ..... A47C 1/0342
2019/0290004 A1* 9/2019 Lawson ..... A47C 1/0355
(Continued)

*Primary Examiner* — Shin H Kim
(74) *Attorney, Agent, or Firm* — LAW OFFICES OF STEVEN W. WEINRIEB

(57) ABSTRACT

A recliner chair, love seat, or sofa comprises a backrest, a seat, a footrest, and pairs of symmetrical, oppositely disposed linkage members for moving the backrest between upright and reclined positions, and for moving the footrest between retracted and extended positions. A protective cover is fixedly attached to the footrest such that opposite sides of forward portions of the pairs of symmetrical, oppositely disposed linkage members are covered so as to prevent parts of young children or pets from being caught within the forward portions of the pairs of symmetrical, oppositely disposed linkage members as the pairs of symmetrical, oppositely disposed linkage members are moving the footrest between its retracted and extended positions. In addition, a single linear actuator is utilized to move both the backrest between its upright and inclined positions, and to move the footrest between its retracted and extended positions.

20 Claims, 7 Drawing Sheets

(56) References Cited

U.S. PATENT DOCUMENTS

| | | | | |
|---|---|---|---|---|
| 2021/0353064 | A1* | 11/2021 | Chen | A47C 17/04 |
| 2022/0047080 | A1* | 2/2022 | Li | A47C 17/04 |

* cited by examiner

RECLINER CHAIR, LOVE SEAT, OR SOFA WITH PROTECTIVE COVER

CROSS-REFERENCE TO RELATED PATENT APPLICATIONS

This patent application is a Continuation of U.S. patent application Ser. No. 17/467,330, which was filed on Sep. 6, 2021.

FIELD OF THE INVENTION

The present invention relates generally to recliner chairs, love seats, or sofas, and more particularly to a protective cover, which is fixedly attached to a protective cover mounting bracket that is located immediately adjacent to, and to the rear of, the footrest section of the recliner chair, love seat, or sofa, wherein the footrest section of the recliner chair, love seat, or sofa can be moved between extended and retracted positions by means of a linear actuator and linkage members operatively connected to the linear actuator, so as to effectively cover the forwardmost linkage members of the recliner chair, love seat, or sofa, and thereby prevent children or pets from becoming injured when the footrest section of the recliner chair, love seat, or sofa is being moved from, for example, its extended position to its retracted position, during which time, the various linkage members are undergoing contracted movements which potentially present a situation where a child's finger, arm, or leg, or a small pet or a pet's head, leg, paw, or tail, can get caught or pinched between the contracting linkage members, thereby injuring the child or pet. In addition, the present invention comprises a recliner chair, love seat, or sofa which effectively moves the back, seat, and foot sections of the recliner chair, love seat, or sofa by means of a single linear actuator through means of strategically positioned and strategically interconnected linkage members and mounting brackets.

BACKGROUND OF THE INVENTION

Powered recliner chairs, love seats, and sofas have become increasingly popular within recent years as consumers choose to incorporate such furniture pieces into their homes and offices. Powered recliner chairs, love seats, or sofas, offer consumers places to relax so that they can comfortably watch TV, read a book, or even take a short nap due to the fact that the recliner chair, love seat, or sofa can be quickly transformed from an upright position to a comfortable substantially supine position by depressing a control button which will activate linear actuators which subsequently move the backrest, seat, and footrest sections of the recliner chair, love seat, or sofa into a substantially horizontal, or any intermediate, position as a result of the linear actuators being operatively connected to various linkage members pivotally attached to each other as well as to backrest, seat, and footrest mounting brackets of the recliner chair, love seat, or sofa. It has been discovered, however, that since the forwardmost linkage members of the recliner chair, love seat, or sofa, that are operatively connected to the footrest section of the recliner chair, love seat, or sofa, are effectively exposed when the footrest section of the recliner chair, love seat, or sofa has been raised to its extended position, such forwardmost linkage members can present a potential danger to small children or pets when the footrest section of the recliner chair, love seat, or sofa is retracted back toward its fully retracted position in view of the fact that such linkage members are being contracted so as to be spatially accommodated within the overall frame of the recliner chair, love seat, or sofa when the footrest section of the recliner chair, love seat, or sofa has in fact attained its fully retracted position.

Still further, in conventional powered recliner chairs, love seats, or sofas, multiple linear actuators are normally provided such that, for example, a first linear actuator is utilized to actuate the backrest and seat sections of the recliner chair, love seat, or sofa through means of a first set of linkage members and mounting brackets, while a second linear actuator is utilized to actuate the footrest section of the recliner chair, love seat, or sofa through means of a second set of linkage members and mounting brackets. It can be readily appreciated that this structural arrangement increases the cost of manufacture of the recliner chair, love seat, or sofa, in view of the fact that first and second linear actuators are required to actuate the various sections of the recliner chair, love seat, or sofa, as well as first and second sets of linkage members and mounting brackets operatively associated with the first and second linear actuators.

Accordingly, a need exists in the art for a new and improved recliner chair, love seat, or sofa. Another need exists in the art for a new and improved recliner chair, love seat, or sofa which will rectify the noted deficiencies characteristic of conventional recliner chairs, love seats, or sofas. An additional need exists in the art for a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa. A further need exists in the art for a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa such that the forwardmost linkage members of the footrest section of the recliner chair, love seat, or sofa, will no longer be exposed. A still further need exists in the art for a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa such that the forwardmost linkage members of the footrest section of the recliner chair, love seat, or sofa, will no longer be exposed such that fingers, arms, or legs of children, or small pets or their heads, legs, paws, or tails, cannot get caught or pinched between the forwardmost linkage members of the footrest section of the recliner chair, love seat, or sofa as the footrest section of the recliner chair, love seat, or sofa is being retracted from its extended position. A yet further need exists in the art for a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa such that the forwardmost linkage members of the footrest section of the recliner chair, love seat, or sofa, will no longer be exposed such that fingers, arms, or legs of children, or small pets or their heads, legs, paws, or tails, cannot get caught or pinched between the forwardmost linkage members of the footrest section of the recliner chair, love seat, or sofa as the footrest section of the recliner chair, love seat, or sofa is being retracted from its extended position whereby the forwardmost linkage members of the footrest section will be contracted so as to be spatially accommodated within the overall frame of the recliner chair, love seat, or sofa when the footrest section of the recliner chair, love seat, or sofa has in fact attained its fully retracted position. A last need exists in the art for a new and improved recliner chair, love seat, or sofa, wherein the various movable sections of the recliner chair, love seat, or sofa, such as, for example, the back section, the seat section, and the footrest section, can be actuated between fully retracted and fully extended positions by means of a single linear actuator operatively connected to various linkage members and mounting brackets.

OVERALL OBJECTIVES OF THE PRESENT INVENTION

Accordingly, an overall objective of the present invention is to provide a new and improved recliner chair, love seat, or sofa. Another overall objective of the present invention is to provide a new and improved recliner chair, love seat, or sofa which will rectify the noted deficiencies characteristic of conventional recliner chairs, love seats, or sofas. An additional overall objective of the present invention is to provide a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa. A further overall objective of the present invention is to provide a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa such that the forwardmost linkage members of the footrest section of the recliner chair, love seat, or sofa, will no longer be exposed. A still further overall objective of the present invention is to provide a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa such that the forwardmost linkage members of the footrest section of the recliner chair, love seat, or sofa, will no longer be exposed such that fingers, arms, or legs of children, or small pets or their heads, legs, paws, or tails, cannot get caught or pinched between the forwardmost linkage members of the footrest section of the recliner chair, love seat, or sofa as the footrest section of the recliner chair, love seat, or sofa is being retracted from its extended position.

A yet further overall objective of the present invention is to provide a new and improved recliner chair, love seat, or sofa which will rectify the noted deficiencies characteristic of conventional recliner chairs, love seats, or sofas, particularly the covering of the forwardmost linkage members of the footrest section of the recliner chair, love seat, or sofa such that the forwardmost linkage members of the footrest section of the recliner chair, love seat, or sofa, will no longer be exposed such that fingers, arms, or legs of children, or small pets or their heads, legs, paws, or tails, cannot get caught or pinched between the forwardmost linkage members of the footrest section of the recliner chair, love seat, or sofa as the footrest section of the recliner chair, love seat, or sofa is being retracted from its extended position whereby the forwardmost linkage members of the footrest section will be contracted so as to be spatially accommodated within the overall frame of the recliner chair, love seat, or sofa when the footrest section of the recliner chair, love seat, or sofa has in fact attained its fully retracted position. A last overall objective of the present invention is to provide a new and improved recliner chair, love seat, or sofa, wherein the various movable sections of the recliner chair, love seat, or sofa, such as, for example, the back section, the seat section, and the footrest section, can be actuated between fully retracted and fully extended positions by means of a single linear actuator operatively connected to various linkage members and mounting brackets.

SUMMARY OF THE INVENTION

The foregoing and other objectives of the present invention are achieved by the present invention which provides a new and improved recliner chair, love seat, or sofa. It is to be noted that while the present invention is equally applicable to recliner chairs, love seats, and sofas, for brevity, this disclosure will be limited to recliner chairs. Accordingly, it will be seen that the recliner chair comprises a movable backrest section, a seat section, and a movable footrest section. A single, dual-directional linear actuator assembly has its motor end operatively connected to an undersurface portion of the seat section, while a telescopic rod of the single, dual-directional linear actuator assembly is operatively connected to a laterally extending synchronization bar which is operatively connected at its opposite ends to a pair of laterally spaced, substantially L-shaped backrest mounting brackets, at positions below the pivotal axes of the laterally spaced, substantially L-shaped backrest mounting brackets, so as to ensure that both of the L-shaped backrest brackets move synchronously together in unison with each other. The upper end sections of the backrest brackets are fixedly connected to opposite sides of the backrest, while terminal end portions of the lower end sections of the laterally spaced backrest brackets are pivotally connected to a pair of laterally spaced seat mounting brackets, as well as being operatively connected to a pair of laterally spaced footrest mounting brackets, by means of a plurality of intervening, interconnected linkage members. An additional pair of laterally spaced seat mounting brackets are connected to the pair of laterally spaced backrest brackets at the vertices where the upper end sections of the backrest brackets and the lower end sections of the backrest brackets meet, and at where the pivotal axes of the pair of laterally spaced backrest brackets are located, while the opposite ends of the synchronization bar are connected to the lower end sections of the backrest brackets at points intermediate the vertices defined between the upper end sections of the backrest brackets and the lower end sections of the backrest brackets, as well as the pivotal axes of the pair of laterally spaced backrest brackets are located, and the terminal end portions of the lower end sections of the backrest brackets.

In this manner, when the telescopic rod is retracted by the single, dual-directional linear actuator motor, the backrest brackets, supporting the backrest section of the recliner chair, will be pivoted backwardly, the seat mounting brackets, supporting the seat section of the recliner chair, will remain at their original seating positions, while the footrest mounting brackets, supporting the footrest section of the recliner chair, will also be moved forwardly and upwardly toward their extended positions. To the contrary, when the telescopic rod of the single, dual-directional linear actuator is extended, the movements of the various mounting brackets and linkage members will be reversed such that the backrest section of the recliner chair, will be pivoted forwardly, the seat mounting brackets, supporting the seat section of the recliner chair, will again remain stationary at their original seating position, and the footrest mounting brackets, supporting the footrest section of the recliner chair, will also be moved rearwardly and downwardly toward their retracted positions. Continuing further, a protective cover, comprising a pair of laterally spaced upstanding side plates connected together by means of a transversely extending bottom plate, is mounted upon a pair of laterally spaced L-shaped mounting brackets or angle irons which are pivotally connected to the pair of laterally spaced, forwardmost linkage members as well as to the pair of laterally spaced footrest mounting brackets. In this manner, the pair of laterally spaced, upstanding side plates, of the protective cover, will not only cover the pair of laterally spaced, forwardmost linkage members such that the pair of laterally spaced, forwardmost linkage members are not readily exposed and thereby no longer pose or present a potential threat of injury to children or pets, but, in addition, internal portions of the recliner chair, defined between, for example, the inner surface of the footrest section and the forwardmost linkage members, will effectively be closed so as to prevent ingress by small children or pets.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
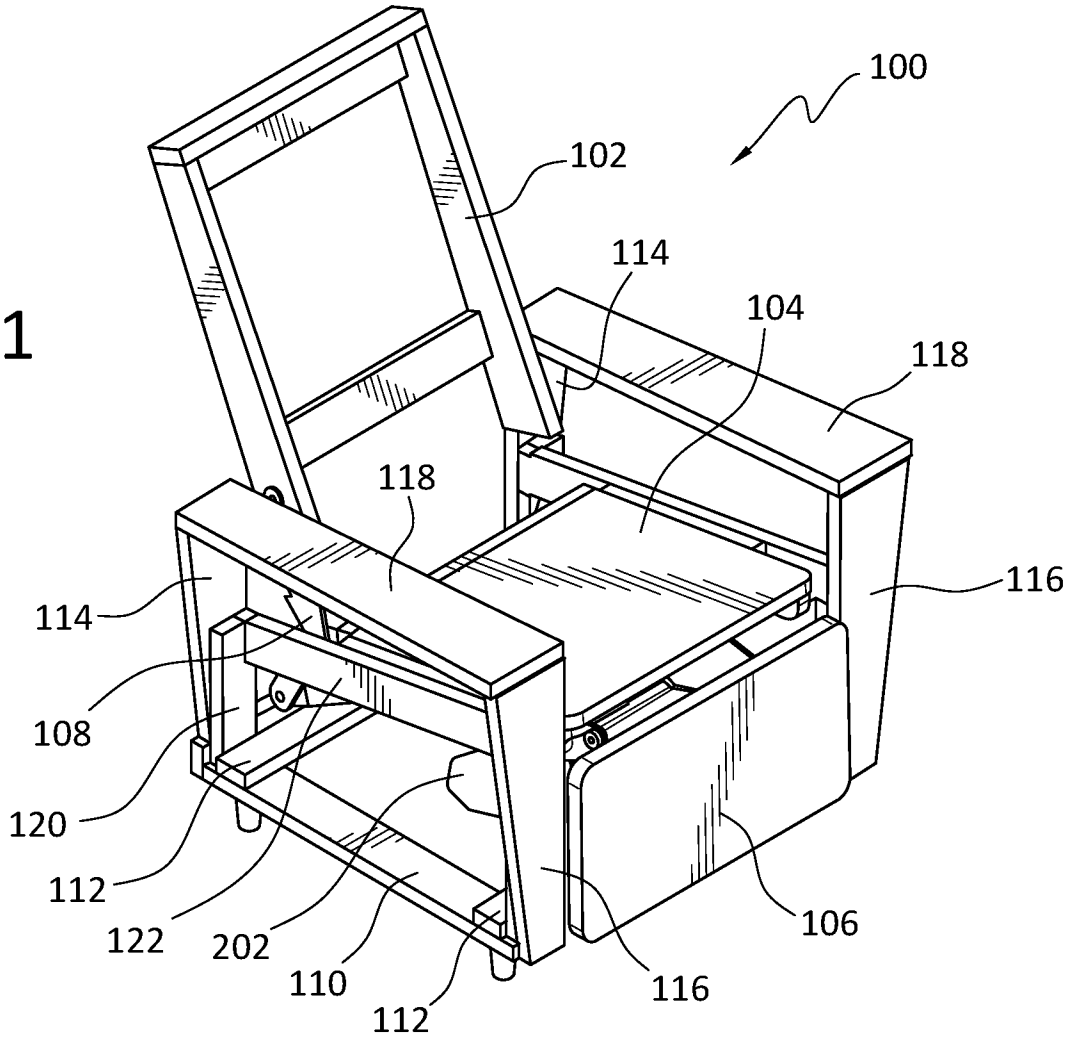
FIG. 1 is a schematic, front, left side, top perspective view of a new and improved recliner chair, constructed in accordance with the principles and teachings of the present invention and showing the recliner chair when the recliner chair is disposed in its seating mode at which, for example, the backrest section and the footrest section are disposed at their retracted positions so as to enable a person to be seated within the recliner chair.
Figure 2:
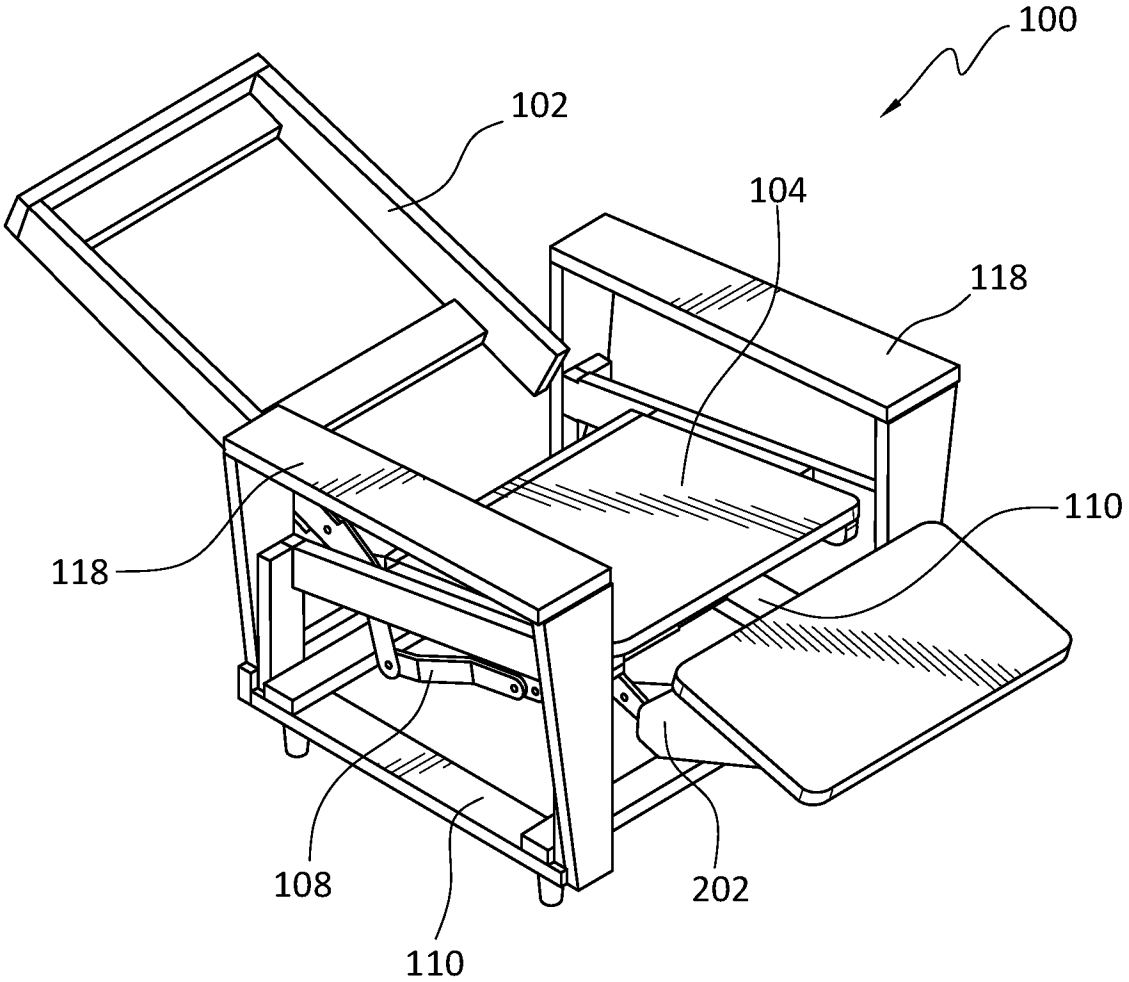
FIG. 2 is a schematic, front, left side, top perspective view of the new and improved recliner chair as illustrated within FIG. 1, showing, however, the recliner chair when the recliner chair is disposed in its reclined mode at which, for example, the backrest section and the footrest section are disposed at their extended positions so as to enable a person to be disposed in a supine position upon the recliner chair.
Figure 3:
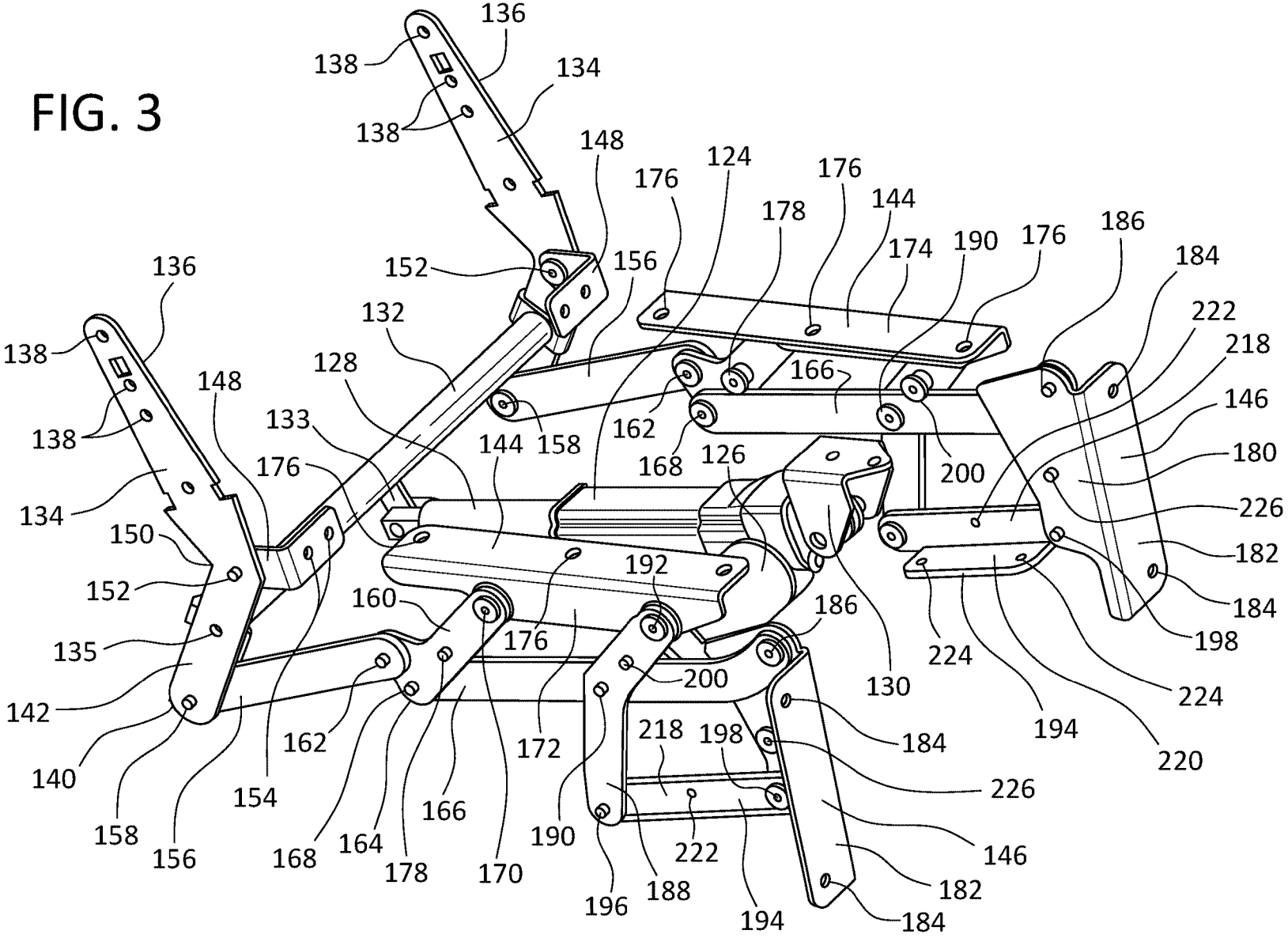
FIG. 3 is a schematic, front, left side, top perspective view of the recliner chair actuating system comprising the single, dual-directional linear actuator, and the plurality of linkage members and mounting brackets which are effectively disposed internally within the recliner chair and which are disposed at their retracted positions such that the recliner chair is disposed in its seating mode as illustrated within FIG. 1.
Figure 4:
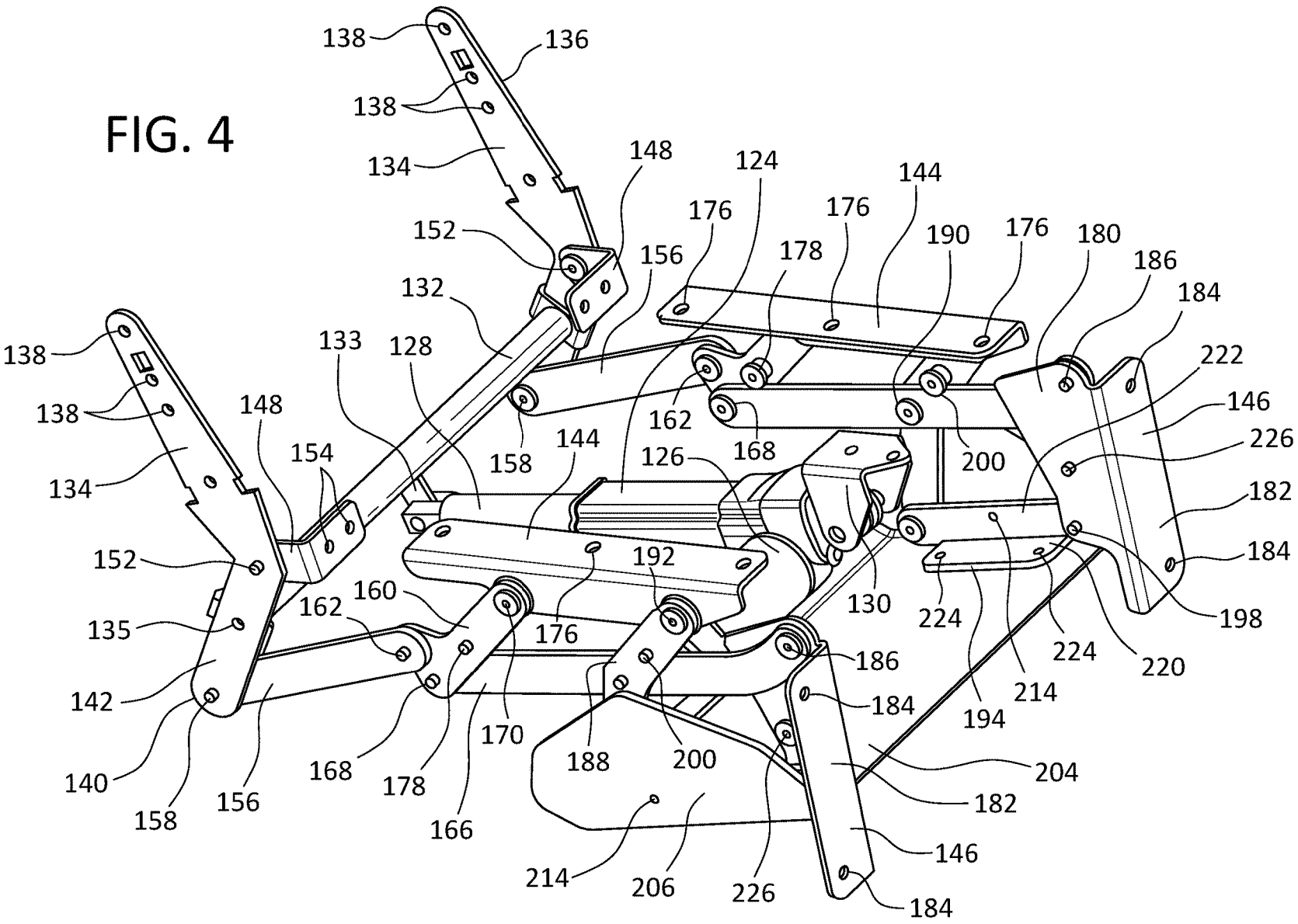
FIG. 4 is a schematic, front, left side, top perspective view, similar to that of FIG. 3, showing the recliner chair actuating system comprising the single, dual-directional linear actuator, and the plurality of linkage members and mounting brackets which are effectively disposed internally within the recliner chair and which are disposed at their retracted positions such that the recliner chair is disposed in its seating mode as illustrated within FIG. 1, but also showing the protective cover comprising the pair of laterally spaced upstanding side plates operatively mounted upon the recliner chair actuating system so as to effectively cover the laterally spaced forwardmost linkage members, operatively connected to the footrest sections of the recliner chair actuating system, such that the laterally spaced forwardmost linkage members, operatively connected to the footrest sections of the recliner chair actuating system, will no longer be exposed and therefore will no longer present a potential threat of injury to a child or pet when the recliner chair is being moved between the reclined and extended positions by means of the plurality of linkage members.
Figure 5:
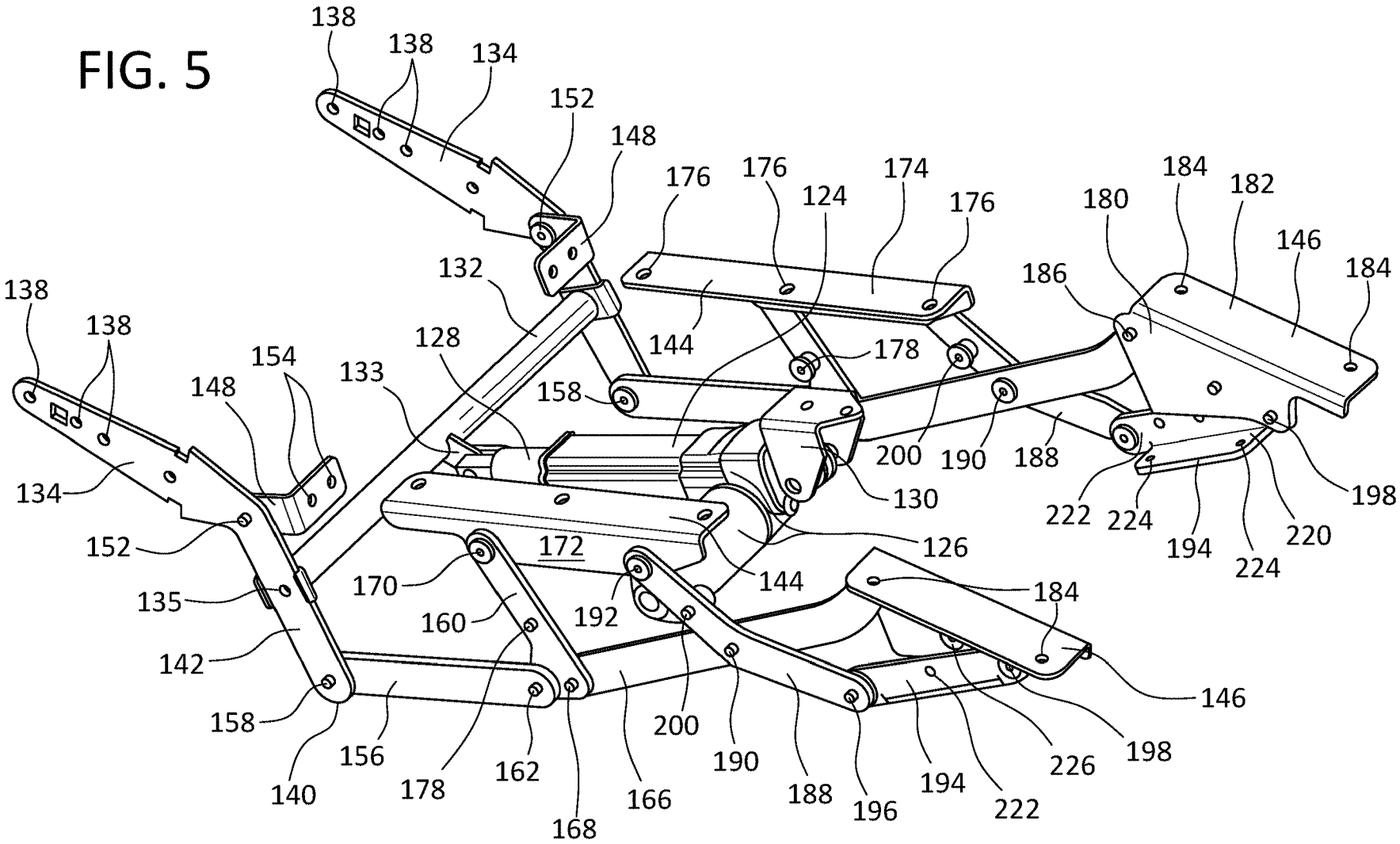
FIG. 5 is a schematic, front, left side, top perspective view of the recliner chair actuating system comprising the single, dual-directional linear actuator, and the plurality of linkage members and mounting brackets which are effectively disposed internally within the recliner chair and which are disposed at their extended positions such that the recliner chair is disposed in its reclined mode as illustrated within FIG. 2.
Figure 6:
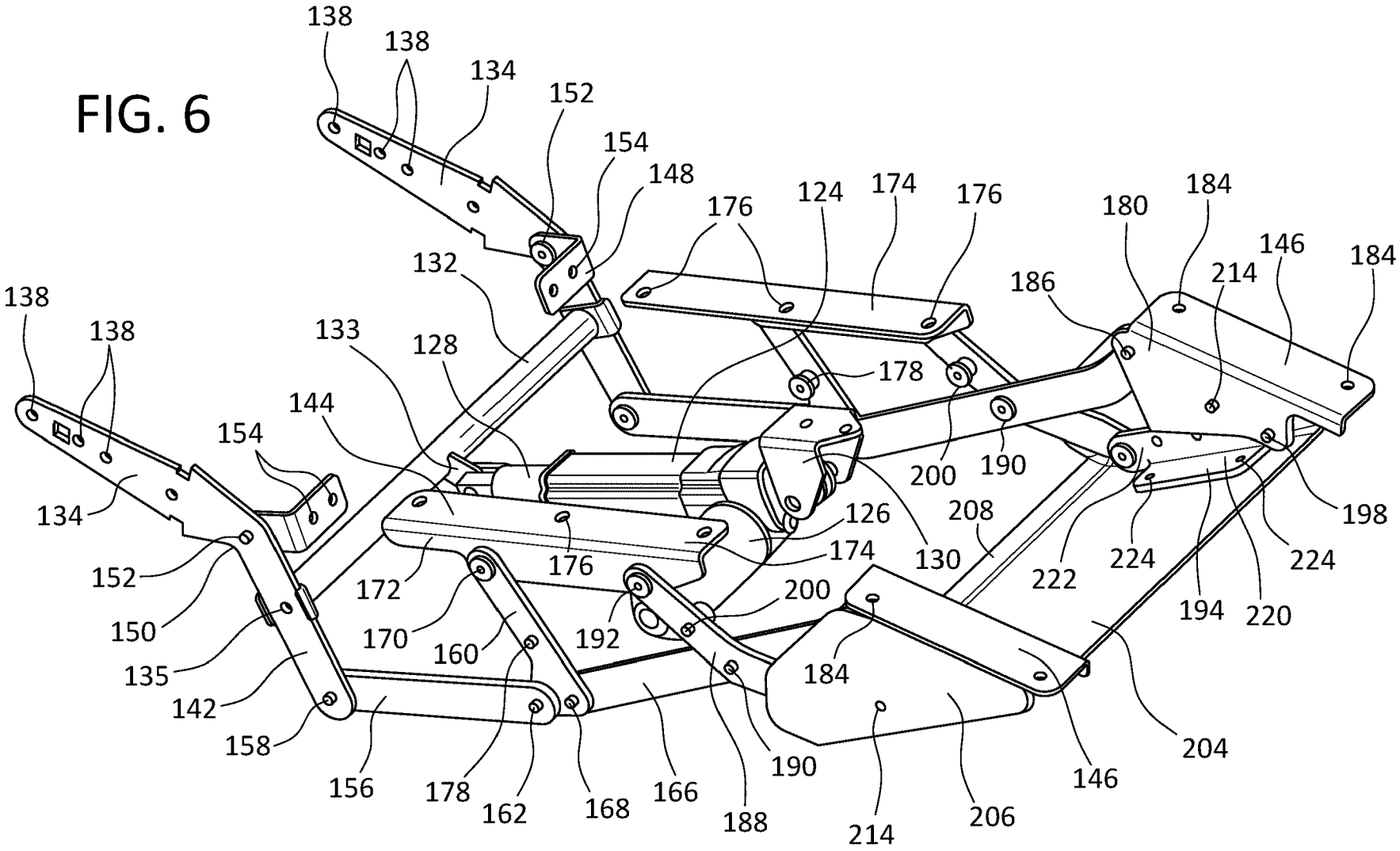
FIG. 6 is a schematic, front, left side, top perspective view, similar to that of FIG. 5, showing the recliner chair actuating system comprising the single, dual-directional linear actuator, and the plurality of linkage members and mounting brackets which are effectively disposed internally within the recliner chair and which are disposed at their extended positions such that the recliner chair is disposed in its reclined mode as illustrated within FIG. 2, but also showing the protective cover comprising the pair of laterally spaced upstanding side plates operatively mounted upon the recliner chair actuating system so as to effectively cover the laterally spaced forwardmost linkage members, operatively connected to the footrest sections of the recliner chair actuating system, such that the laterally spaced forwardmost linkage members, operatively connected to the footrest sections of the recliner chair actuating system, will no longer be exposed and therefore will no longer pose or present a potential threat of injury to a child or pet when the recliner chair is being moved between the reclined and extended positions by means of the plurality of linkage members.

Referring now to the drawings, and more particularly to FIGS. 1 and 2 thereof, a new and improved recliner chair, as constructed in accordance with the principles and teachings of the present invention, is disclosed and is generally indicated by the reference character 100. More particularly, it is seen that the recliner chair 100 comprises a backrest section 102 which is pivotally movable between upright and backwardly inclined positions as can be respectively appreciated from FIGS. 1 and 2, a seat section 104, and a footrest section 106 which is movable between retracted and extended positions as can also be respectively appreciated from FIGS. 1 and 2. As will become better understood from subsequent portions of this disclosure, the backrest section 102, the seat section 104, and the footrest section 106 are interconnected by means of a pair of oppositely disposed, laterally symmetrical, linkage member assemblies 108,108, only one of which can be seen within FIGS. 1 and 2, and the pair of oppositely disposed linkage member assemblies 108, 108 are operatively connected to a single, dual-directional linear actuator which is not shown within FIGS. 1 and 2 but which will be disclosed subsequently hereinafter.

Accordingly, it can be generally appreciated or understood that as the single, dual-directional linear actuator is, for example, contracted, the backrest section 102 will be moved from its upright position as illustrated within FIG. 1, to its inclined position as illustrated within FIG. 2, the seat section will remain stationary, and the footrest section 106 will be moved from its retracted position as illustrated within FIG. 1 to its extended position as illustrated within FIG. 2. Still yet further, it is also seen that the recliner chair 100 comprises a frame structure which includes a pair of laterally spaced base members 110,110 extending longitudinally from rearward corner base sections of the frame structure to forward corner base sections of the frame structure, a pair of longitudinally spaced base members 112,112 interconnecting the pair of laterally spaced, longitudinally extending base members 110,110 together at the rearward corner base sections of the frame structure and at the forward corner base sections of the frame structure, a pair of laterally spaced, rearwardly disposed, upstanding frame members 114,114 which are fixedly secured at their lower end portions to the rearward corner base sections of the frame structure, a pair of laterally spaced, forwardly disposed, upstanding frame members 116, 116 which are fixedly secured at their lower end portions to the forward corner base sections of the frame structure, and a pair of laterally spaced, horizontally oriented left and right side arm members 118,118 as viewed within FIGS. 1 and 2, which are respectively fixedly attached to the upper free end portions of left side upstanding frame members 114 and 116, and to the upper free end portions of the right side upstanding frame members 114, 116. Still further, additional vertical and horizontal bracing or support members 120, 120, 122, 122 may also be fixedly secured to interior surface portions of the rearward and forward upstanding frame members 114, 114, 116, 116 so as to enhance the structural integrity of the entire frame system.

In order to move the backrest section 102 of the chair 100, as well as the footrest section 106 of the chair 100, between their extended and retracted positions, a single, dual-directional linear actuator, along with a plurality of interconnected linkage members and mounting brackets, are provided in accordance with the principles and teachings of the present invention. More particularly, as can best be appreciated from FIGS. 3-6, it is seen that a single, dual-directional linear actuator assembly 124 comprises a motor 126 and a telescopic rod 128 which is telescopically moved between extended and retracted positions by means of the motor 126. The motor 126 is seen to be pivotally connected to a motor mounting bracket 130 which is fixedly secured to an undersurface portion of the seat section 104, while the free end of the telescopic rod 126 of the single, dual-directional linear actuator assembly 124 is pivotally connected to a laterally extending synchronization bar 132 by means of a suitable mounting bracket 133, the opposite ends of the synchronization bar 132 being fixedly secured to a pair of laterally spaced, substantially L-shaped backrest mounting brackets 134, 134 by means of suitable fasteners passing through holes 135, only one of which is visible, so as to ensure that both of the L-shaped backrest mounting brackets 134, 134 move synchronously together in unison with each other. The upper end sections 136, 136 of the L-shaped backrest mounting brackets 134, 134 are adapted to be fixedly connected to opposite sides of the backrest 102 by means of suitable fasteners passing through holes or apertures 138, 138 while terminal end portions 140, 140 of the lower end sections 142, 142 of the laterally spaced L-shaped backrest mounting brackets 134, 134 are operatively connected to a pair of laterally spaced, longitudinally extending seat mounting brackets 144,144, as well as to a pair of laterally spaced footrest mounting brackets 146, 146, by means of a plurality of intervening, interconnected linkage members and mounting brackets which will be described shortly hereinafter. An additional pair of laterally spaced L-shaped seat mounting brackets or angle irons 148, 148 are pivotally mounted to the pair of laterally spaced backrest brackets 134, 134 at the vertices 150, 150 where the upper end sections 136, 136 of the backrest brackets 134, 134 and the lower end sections 142,142 of the backrest brackets 134, 134 meet, by means of pivot pins 152, 152 extending through first legs of the mounting brackets or angle irons 148, 148, while the second legs of the mounting brackets or angle irons 148, 148 are adapted to be fixedly secured to laterally spaced rear surface portions of the seat section 104 by means of suitable fasteners being passed through holes or apertures 154, 154.

With reference continuing to be made to FIGS. 3-6, the operative connections defined between the pair of laterally spaced backrest mounting brackets 134, 134 and the pair of laterally spaced seat mounting brackets 144, 144, as well as between the pair of laterally spaced backrest mounting brackets 134, 134 and the pair of laterally spaced footrest mounting brackets 146, 146, by means of the aforenoted intervening and interconnected linkage members and mounting brackets, will now be described. More particularly, it is seen that the terminal end portions 140.140 of the lower end sections 142,142 of the laterally spaced L-shaped backrest brackets 134.134 are pivotally connected to first linkage members 156, 156 by means of pivot pins 158,158, while the opposite ends of the first linkage members 156, 156 are pivotally connected to second linkage members 160,160, having a substantially L-shaped configuration, by means of pivot pins 162,162. The vertex portions 164, 164 of the second linkage members 160, 160 that is, those portions of the second linkage members 160, 160 at which the long, substantially vertical sections of the second linkage members 160, and the, short, substantially horizontal sections of the second linkage members 160, meet, are pivotally connected to first end portions of third, longitudinally extending linkage members 166, 166 by means of pivot pins 168, 168, while upper end portions of the long, substantially vertical sections of each one of the second linkage members 160, 160 are pivotally connected to the laterally spaced seat mounting brackets 144,144 by means of pivot pins 170,170. It is to be appreciated that each one of the laterally spaced seat mounting brackets 144, 144 actually comprises a longitudinally extending angle iron comprising a vertically oriented mounting bracket section 172,172 to which the second linkage members 160, 160 are pivotally attached by means of the pivot pins 170,170, and a horizontally oriented mounting bracket section 174, 174 to which the seat section 104 of the chair 100 is to be fixedly attached by means of suitable fasteners which are adapted to be inserted through a plurality of holes 176, 176 defined within the horizontally oriented mounting bracket section 174, 174. Lastly, the second linkage members 160, 160 are provided with first limit pins 178,178, the purpose of which will be explained hereinafter when the overall operation of the new and improved chair 100 is discussed in detail.

Continuing further, it is seen that each one of the pair of laterally spaced footrest mounting brackets 146,146 actually comprises an angle iron, similar to each one of the seat mounting brackets 144, 144, wherein it is seen that each footrest mounting bracket 146, 146 comprises a first mounting bracket section 180,180 which faces inwardly so that both first mounting bracket sections 180, 180 effectively face each other, and a second mounting bracket section 182, 182 which is disposed at substantially 90° with respect to the first mounting bracket sections 180, 180. In addition, it is seen that the opposite ends of each one of the second mounting bracket sections 182, 182 are provided with holes or apertures 184,184 through which suitable fasteners may be inserted so as to fixedly attach the footrest section 106 of the chair 100 to the footrest mounting brackets 146, 146. Accordingly, still further, it is seen that the second opposite end of each one of the third linkage members 166, 166 is pivotally connected to an upper end portion of each one of the inwardly facing mounting bracket sections 180,180 of the footrest mounting brackets 146, 146 by means of pivot pins 186, 186. It is additionally seen that fourth linkage members 188, 188, are pivotally mounted upon a central or intermediate portion of each one of the third linkage members 166, 166 by means of pivot pins 190, 190. Each one of the fourth linkage members 188,188 is also seen to have a substantially L-shaped configuration, and it is seen that the upper end portion of each one of the fourth linkage members 188, 188 is pivotally connected to the vertically oriented mounting bracket section 172, 172 of each seat mounting bracket 144, 144 by means of a pivot pin 192,192, while the lower end portion of each one of the fourth linkage members 188, 188 is pivotally connected to one end of a protective cover mounting bracket 194, 194 by means of a pivot pin 196, 196. The opposite end of each one of the protective cover mounting brackets 194, 194 is pivotally connected to a respective one of the inwardly facing mounting bracket sections 180, 180 of the footrest mounting brackets 146, 146 by means of pivot pins 198, 198. Lastly, it is seen that each one of the fourth linkage members 188, 188 is provided with a second limit pin 200,200, the purpose of which will be explained hereinafter when the overall operation of the new and improved chair 100 is discussed in detail.

Figure 7:
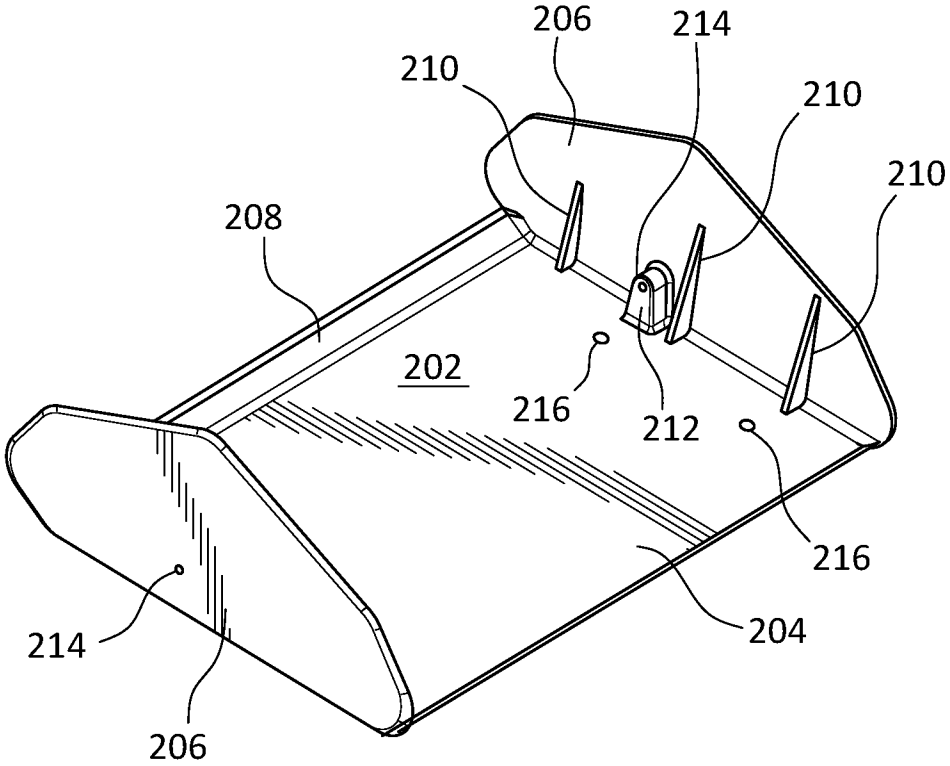
FIG. 7 is a schematic, front, left side, top perspective view of the protective cover wherein, once mounted upon the recliner chair actuating system, the pair of laterally spaced upstanding side walls of the protective cover will effectively cover the laterally spaced forwardmost linkage members, operatively connected to the footrest sections of the recliner chair actuating system, such that the laterally spaced forwardmost linkage members, operatively connected to the footrest sections of the recliner chair actuating system, will no longer be exposed and will therefore no longer pose or present a potential threat of injury to a child or pet.

Continuing still further, and with additional reference being made to FIG. 7, a protective cover 202 is shown and is adapted to be fixedly secured upon the protective cover mounting brackets 194, 194. More particularly, it is seen that the protective cover 202 has a substantially U-shaped cross-sectional configuration and accordingly comprises a downwardly facing bottom plate 204, and a pair of upstanding side plates 206,206 which have their lower end portions integrally secured to opposite end portions of the bottom plate 204. A laterally extending connection bar 208 is also provided so as to rigidly interconnect the pair of upstanding side plates 206,206 together. Still further, it is also seen that each one of the upstanding side plates 206,206 is provided with at least one vertically orienting reinforcing rib 210, as well as housings 212,212, only one of which is visible, within which first through-holes 214 are defined for receiving suitable fasteners which will pass through the first through-holes 214,214, and second through-holes 216,216 which are defined within opposite ends of the bottom plate 204 for receiving suitable fasteners which will likewise pass through the second through-holes 216,216, all of such fasteners serving to fixedly secure the protective cover 202 upon the protective cover mounting brackets 194, 194.

More particularly, reverting back to FIGS. 3-6, it can be seen that each one of the protective cover mounting brackets 194, 194 actually comprises an L-shaped mounting bracket or angle iron comprising a vertically oriented, inwardly facing section 218,218, and a horizontally oriented, upwardly facing section 220,220, only one which is visible, such that the two inwardly facing sections 218,218 effectively face each other. It is further seen that each one of the vertically oriented sections 218,218 of the protective cover mounting brackets 194, 194 is provided with a bore or aperture 222,222 which is adapted to receive the fastener passing through the first through-bore 214,214 defined within each one of the housings 212,212 of the protective cover 202, while each one of the horizontally oriented sections 220,220 is provided a pair of bores or apertures 224,224 for receiving the fasteners passing through the second through-bores 216,216 defined within the bottom plate 204 of the protective cover 202. As can best be appreciated from FIGS. 4 and 6, when the protective cover 202 has been attached to the protective cover mounting brackets 194, 194, the side plates 206,206 of the protective cover 202 will cover the lower end portions of the fourth linkage members 188, 188 and the protective cover mounting brackets 194, 194, as well as effectively blocking ingress into other internal regions of the recliner chair 100, such as, for example, the region defined between the protective cover 202 and the footrest section 106 attached to the footrest mounting brackets 146, 146, whereby children or small pets cannot readily enter such region, or get parts of their bodies caught within such region, and thereby potentially get injured when the footrest section 106 of the recliner chair 100 is being moved between its extended and retracted positions. Lastly, it is seen that each one of the first mounting bracket sections 180, 180 of the laterally spaced footrest mounting brackets 146, 146 is provided with a third limit pin 226,226, the purpose of which will be explained hereinafter when the overall operation of the new and improved chair 100 is discussed in detail.

Having described substantially all of the structural components of the new and improved recliner chair 100 of the present invention, the operation of the same will now be described. More particularly, when the recliner chair 100 is disposed in the seating position as illustrated within FIG. 1, the retraction of the telescopic rod 128 of the single linear actuator assembly 124 will pull the synchronization bar 132 forwardly such that the pair of laterally spaced backrest mounting brackets 134, 134 will be pivoted around the pivot pins 152 in the counterclockwise direction. Accordingly, the backrest 102, fixedly secured to the backrest mounting brackets 134, 134, will be moved rearwardly toward its reclined position, while the lower end sections 142, 142 of the backrest mounting brackets 134, 134 will cause the first linkage members 156, 156 to be moved forwardly which, in turn, causes the second linkage members 160, 160, which are pivotally connected to the first linkage members 156, 156 by means of pivot pin connections 162, 162, to likewise be pivotally moved in the counterclockwise direction around the pivot pins 170,170 which pivotally attach the second linkage members 160, 160 to the seat mounting brackets 144, 144. Simultaneously therewith, the second linkage members 160, 160 will also cause the third linkage members 166,166, which are connected to the second linkage members 160, 160 by means of pivot pins 168, 168, to be moved forwardly which will, in turn, cause the fourth linkage members 188, 188 to rotate in the counterclockwise direction around pivotal connections 192, 192 which pivotally connect the fourth linkage members 188,188 to the vertically dependent or oriented sections 172, 172 of the seat mounting brackets 144, 144. Accordingly, the lower end portions of the fourth linkage members 188,188, which are pivotally connected to the protective cover mounting brackets 194, 194, will drive the protective cover mounting brackets 194, 194 in the forward direction whereby, as a result of the forward movements of both the third linkage members 166, 166 and the protective cover mounting brackets 194, 194, wherein the protective cover mounting brackets 194, 194 are pivotally connected to the footrest mounting brackets 146, 146, the footrest mounting brackets 146, 146, upon which the footrest section 106 of the recliner chair 100 is mounted, will be moved forwardly and upwardly toward its extended or elevated position, as a result of the pivotal movements of the footrest mounting brackets 146, 146 around the upper and lower pivot pins 186, 186 and 198, 198, until the upper edge portions of the vertically oriented sections 218,218 of the protective cover mounting brackets 194, 194 encounter the third limit pins 226,226, mounted upon the inwardly facing mounting bracket sections 180, 180 of the footrest mounting brackets 146, 146, such that the elevation and extension of the footrest mounting brackets 146, 146, and the footrest section 106 mounted thereon, can no longer be elevated or extended, all as can best be appreciated from FIG. 5. To the contrary, when the telescopic rod 128 of the single linear actuator assembly 124 is extended, the various aforenoted components will move in the reverse directions, it being particularly noted that when the backrest 102 and the footrest 106 are moved back to their original seating positions as illustrated within FIG. 1, the first and second limit pins 178, 178 and 200,200, respectively mounted upon the second linkage members 160, 160 and the fourth linkage members 188,188, will encounter upper edge portions of the third linkage members 166, 166 so as to prevent further retractive movement of the backrest 102 and the footrest 106, as can be readily appreciated from FIGS. 3 and 4.

Thus, it may be seen that in accordance with the principles and teachings of the present invention, a single linear actuator has been provided and operatively connected to both said backrest and said footrest for moving both said backrest between said upright and reclined positions, and said footrest between said retracted and extended positions. Accordingly, the overall actuator system of the recliner chair has been simplified, and the manufacturing costs accordingly reduced. In addition, by providing the protective covers so as to cover the forward end portions of the plurality of linkage members, as well as the protective cover mounting brackets connected to the forward end portions of the plurality of linkage members and portions of the footrest mounting brackets, the forward end portions of the plurality of linkage members are effectively covered, and, in addition, ingress into those regions, defined between the forward end portions of the plurality of linkage members and the footrest mounting brackets, is effectively blocked, so as to prevent small children or pets from getting parts of their bodies caught in the forward end portions of the plurality of linkage members, as well as within the regions defined between the forward end portions of the plurality of linkage members and the footrest mounting brackets, whereby small children or pets cannot be injured as the plurality of linkage members move the footrest between its retracted and extended positions.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by letters patent is:

1. A furniture piece, comprising:

a backrest movable between upright and reclined positions;

a seat;

a footrest movable between retracted and extended positions;

a plurality of linkage members interconnected together and operatively connected to said backrest at rearward portions of said plurality of linkage members, and operatively connected to said footrest at forward portions of said plurality of linkage members, for moving said backrest between said upright and reclined positions, and for moving said footrest between said retracted and extended positions;

at least one linear actuator operatively connected to said plurality of linkage members for moving said plurality of linkage members so as to in turn move said backrest between said upright and reclined positions, and to move said footrest between said retracted and extended positions; and a protective cover fixedly connected to said footrest so as to depend downwardly from said footrest and thereby cover said forward portions of said plurality of linkage members so as to prevent a child or pet from being injured by said forward portions of said plurality of linkage members as said plurality of linkage members move said footrest between said retracted and extended positions.

2. The furniture piece as set forth in claim 1, wherein:

said furniture piece is selected from the group comprising a chair, a love seat, and a sofa.

3. The furniture piece as set forth in claim 1, wherein:

said plurality of linkage members comprise a pair of symmetrical, oppositely disposed sets of linkage members disposed upon opposite sides of said furniture piece.

4. The furniture piece as set forth in claim 3, further comprising:

a pair of laterally spaced, oppositely disposed backrest mounting brackets, upon which said backrest is fixedly mounted, operatively connected to said pair of symmetrical, oppositely disposed sets of linkage members disposed upon opposite sides of said furniture piece.

5. The furniture piece as set forth in claim 4, further comprising:

a synchronization bar fixedly connected to said pair of laterally spaced, oppositely disposed backrest mounting brackets so as to ensure that said pair of laterally spaced, oppositely disposed backrest mounting brackets move in unison together when moving said backrest between said upright and said inclined positions.

6. The furniture piece as set forth in claim 5, wherein:

said at least one linear actuator is operatively connected to said synchronization bar for moving said backrest mounting brackets, upon which said backrest is fixedly secured, between said upright and reclined positions.

7. The furniture piece as set forth in claim 1, wherein:

said at least one linear actuator is operatively connected to plurality of linkage members for moving said footrest between said retracted and extended positions.

8. The furniture piece as set forth in claim 1, further comprising:

a plurality of limit pins operatively associated with said plurality of linkage members for limiting the movement of said backrest between said upright and reclined positions, and for limiting the movement of said footrest between said retracted and extended positions.

9. The furniture piece as set forth in claim 1, further comprising:

a pair of oppositely disposed, longitudinally extending seat mounting brackets for mounting said seat thereon.

10. The furniture piece as set forth in claim 4, further comprising:

a pair of laterally spaced seat mounting brackets pivotally mounted upon said pair of laterally spaced, opposite disposed backrest mounting brackets and adapted to be fixedly secured to rear end surface portions of said seat for pivotally securing said rear end portions of said seat upon said pair of laterally spaced, oppositely disposed backrest mounting brackets.

11. A furniture piece, comprising:

a backrest movable between upright and reclined positions;

a seat;

a footrest movable between retracted and extended positions;

a plurality of linkage members interconnected together and operatively connected to said backrest at rear portions of said plurality of linkage members and operatively connected to said footrest at forward portions of said plurality of linkage members for moving said backrest between said upright and reclined positions, and for moving said footrest between said retracted and extended positions; and a single linear actuator operatively connected to said backrest for moving said backrest between said upright and reclined positions, and operatively connected to said plurality of linkage members for moving said footrest between said retracted and extended positions, when said single linear actuator is extended and retracted, respectively.

12. The furniture piece as set forth in claim 11, wherein:

said furniture piece is selected from the group comprising a chair, a love seat, and a sofa.

13. The furniture piece as set forth in claim 11, wherein:

said plurality of linkage members comprise a pair of symmetrical, oppositely disposed sets of linkage members disposed upon opposite sides of said furniture piece.

14. The furniture piece as set forth in claim 13, further comprising:

a pair of laterally spaced, oppositely disposed backrest mounting brackets, upon which said backrest is fixedly mounted, operatively connected to said pair of symmetrical, oppositely disposed sets of linkage members disposed upon opposite sides of said furniture piece.

15. The furniture piece as set forth in claim 14, further comprising:

a synchronization bar fixedly connected to said pair of laterally spaced, oppositely disposed backrest mounting brackets so as to ensure that said pair of laterally spaced, oppositely disposed backrest mounting brackets move in unison together when moving said backrest between said upright and said inclined positions.

16. The furniture piece as set forth in claim 15, wherein:

said single linear actuator is operatively connected to said synchronization bar for moving said pair of laterally spaced, oppositely disposed backrest mounting brackets, and said backrest mounted upon said pair of laterally spaced, oppositely disposed backrest mounting brackets, between said upright and reclined positions.

17. The furniture piece as set forth in claim 11, wherein:

said single linear actuator is operatively connected to said plurality of linkage members for moving said footrest between said retracted and extended positions.

18. The furniture piece as set forth in claim 11, further comprising:

a plurality of limit pins operatively associated with said plurality of linkage members for limiting the movement of said backrest between said upright and reclined positions, and for limiting the movement of said footrest between said retracted and extended positions.

19. The furniture piece as set forth in claim 11, further comprising:

a pair of oppositely disposed, longitudinally extending seat mounting brackets for mounting said seat thereon.

20. The furniture piece as set forth in claim 14, further comprising:

a pair of laterally spaced seat mounting brackets pivotally mounted upon said pair of laterally spaced, oppositely disposed backrest mounting brackets and adapted to be fixedly secured to rear end surface portions of said seat for pivotally securing said rear end portions of said seat upon said pair of laterally spaced, oppositely disposed backrest mounting brackets.

* * * * *